US005505300A

United States Patent [19]

Joh

[11] Patent Number: 5,505,300

[45] Date of Patent: Apr. 9, 1996

[54] GOLF CLUB DIVIDER INSERT AND GOLF BAG

[76] Inventor: William K. Joh, 6852 Vachon Dr., Bloomfield Hills, Mich. 48301

[21] Appl. No.: 410,913

[22] Filed: Mar. 27, 1995

[51] Int. Cl.[6] ..... A63B 55/04

[52] U.S. Cl. ..... 206/315.6; 206/315.8

[58] Field of Search ..... 206/315.3, 315.6, 206/315.7, 315.8

[56] References Cited

U.S. PATENT DOCUMENTS

| | | | |
|---|---|---|---|
| 1,417,380 | 5/1922 | Hatch | 206/315.6 |
| 1,696,062 | 12/1928 | Thurlow et al. | 206/315.7 X |
| 1,918,447 | 7/1933 | Blatz | 206/315.5 |
| 2,752,973 | 7/1956 | Stamp | 206/315.6 |
| 2,860,679 | 11/1958 | Kouke | 206/315.6 X |
| 3,954,239 | 5/1976 | Kerbs, Jr. | 248/96 |
| 3,967,667 | 7/1976 | Robinson | 206/315.6 |
| 4,111,248 | 9/1978 | Leichhardt | 206/315.6 |
| 4,266,589 | 5/1981 | Cochran | 206/315.3 |
| 4,673,082 | 6/1987 | Hemme | 206/315.6 |
| 4,703,851 | 11/1987 | Stewart | 206/315.8 X |
| 4,753,446 | 6/1988 | Mills | 206/315.6 X |
| 4,838,416 | 6/1989 | Carman | 206/315.2 |
| 4,881,638 | 11/1989 | Cho | 206/315.5 X |
| 5,004,100 | 4/1991 | Smith . | |
| 5,099,990 | 3/1992 | Antonious | 206/315.6 |
| 5,279,414 | 1/1994 | Brasher | 206/315.3 X |

FOREIGN PATENT DOCUMENTS

| | | | |
|---|---|---|---|
| 650681 | 4/1992 | Australia | 206/315.3 |
| 276276 | 4/1927 | United Kingdom | 206/315.3 |
| 438747 | 11/1935 | United Kingdom | 206/315.5 |
| 2130102 | 5/1984 | United Kingdom | 206/315.6 |

*Primary Examiner*—Sue A. Weaver

*Attorney, Agent, or Firm*—Gifford, Krass, Groh, Sprinkle, Patmore, Anderson & Citkowski

[57] ABSTRACT

A golf club divider insert and golf bag for a set of golf clubs includes a golf bag having a base, a body and an open top. The divider insert includes an elongated and sleeve shaped member which is inserted within the golf bag and includes a plurality of elongated and circumferentially extending and spaced apart vanes which define a plurality of elongated enclosures within the bag for receiving the golf clubs. A plurality of foldable flap support members are hingedly attached to the plurality of vanes and each has a horizontal support ledge which allow the insert to be lifted a distance in the bag. Thus, the foldable flap members reach the height of the club head and each club is secured and protected from damage.

12 Claims, 4 Drawing Sheets

Fig - 4
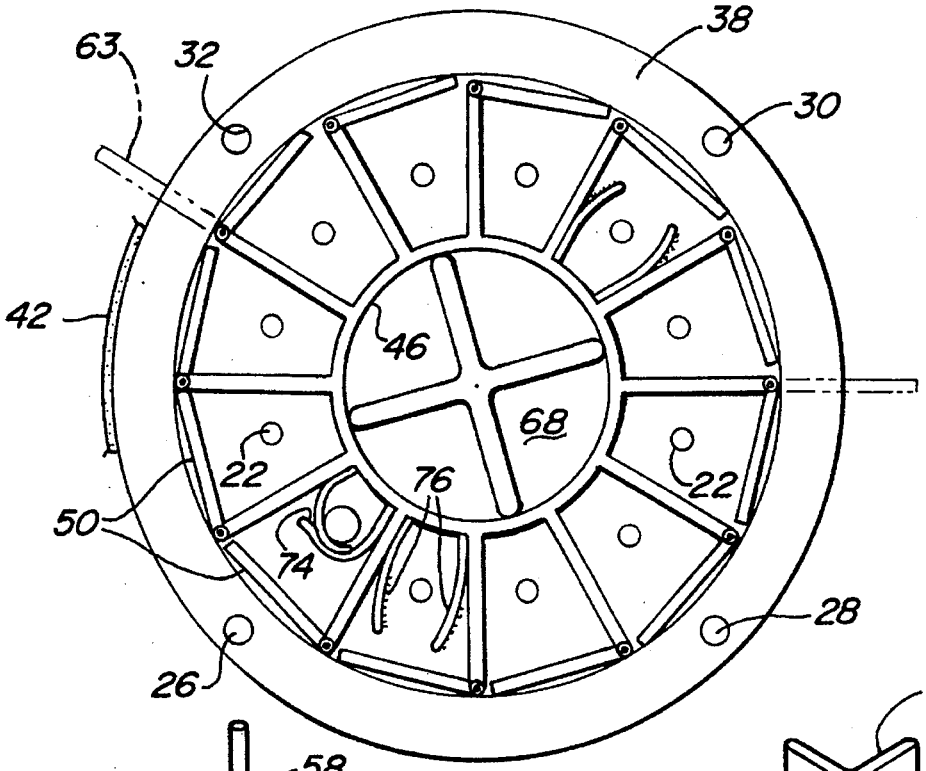
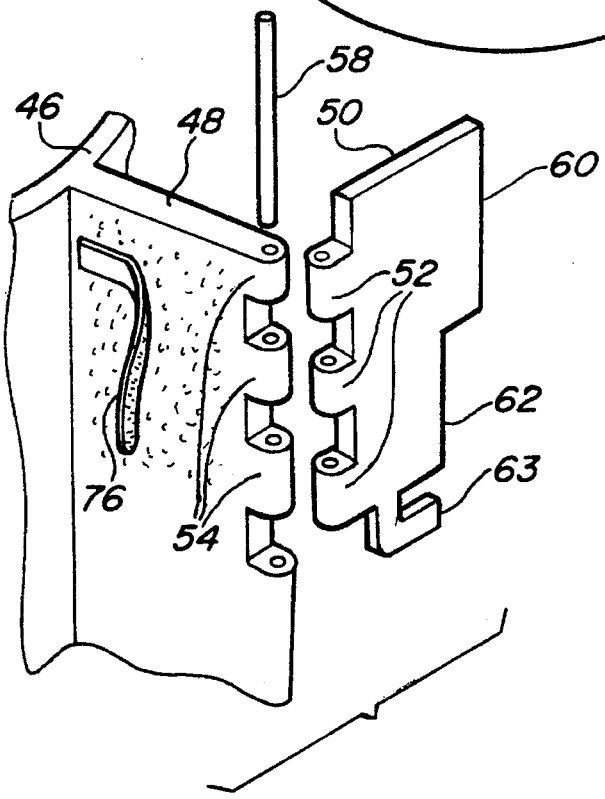
Fig - 5
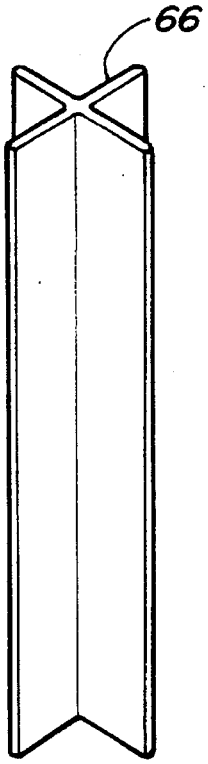
Fig - 6

GOLF CLUB DIVIDER INSERT AND GOLF BAG

BACKGROUND OF THE INVENTION

1. Field of the Invention

The present invention relates generally to golf club carrying devices and, more particularly, to a golf club divider insert and a golf bag.

2. Description of the Prior Art

Various kinds of holding and carrying bags for a set of golf clubs are known in the art. These bags are designed to carry a set of golf clubs which usually includes a set of drivers and a dozen or so golf irons plus a putter and a pitching wedge. When you add in an optional ball retriever and umbrella and such things as golf balls and related golf paraphernalia to the normal complement of a set of clubs, you can appreciate how cluttered the inside of a conventional golf bag can become.

U.S. Pat. No. 4,709,814, issued to Antonious, teaches a rotatable golf club holder insert for a golf bag. The insert is adapted to be inserted within a golf bag and includes a series of golf club dividers forming separate compartments for receiving the golf clubs. Coupling means are associated with the golf bag for permitting the insert to be rotated in either direction so that the insert may be relocated to an optimum frontal position enabling the golfer to quickly and conveniently withdraw or replace a club from or in the bag.

U.S. Pat. No. 5,188,243, issued to Ruiz, teaches a golf club holder insert which includes a plurality of tubes for receiving golf club shafts. The tubes are arranged in a spaced-apart manner and are mounted within a cylindrical insert which is in turn slidably engaged within a flexible outer bag.

The shortcoming of these prior art patents is that they fail to disclose a device capable of optimally locating and separating each individual golf club of a complete set of golf clubs within a golf bag so that the clubs are easily distinguishable from one another and so that they are not scratched or damaged by constantly being knocked against one another while being carried within the bag.

SUMMARY OF THE PRESENT INVENTION

The present invention is a golf club divider insert and golf bag for arranging a set of golf clubs within compartmented enclosures. The golf bag includes a base, a body and an open top. The body is constructed of a plurality of spaced support disks which are secured in place by support rods extending upwardly from the base. The divider insert includes an elongated hollow and cylindrical sleeve shaped member having a plurality of vane portions which extend from the cylindrical sleeve shaped member at intervals around a circumference of the cylindrical sleeve member. The insert is placed within the golf bag so that the vane portions contact an inside edge of a portion of the bag structure and form a plurality of enclosures for receiving the set of clubs.

According to the invention a plurality of foldable hinge support flaps are secured by hinges to upper portions of the vane portions. The foldable hinge support flaps are utilized to change the vertical position of the divider insert. In a first position, the flaps are folded inwardly so as to fit within a perimeter of the divider insert and to permit the insert to be slidably contained in the golf bag. In a second position, the insert is manually elevated a sufficient distance so that the flaps clear an upper support disk of the bag and the flaps are manually rotated in an axial and outward direction to engage a top surface of the upper support disk of the bag. The top of the insert and support flaps are thus supported in an elevated position sufficiently further above the top of the bag so that the divider insert will shield and protect golf club heads during use.

BRIEF DESCRIPTION OF THE DRAWING

Reference will now be made to the attached drawing, when read in combination with the following specification, wherein like reference numerals refer to like parts throughout the several views, and in which:

FIG. 4 is a plan view of the divider insert with the hinges in a folded position and inserted within the golf bag structure;

FIG. 5 is a view similar to FIG. 3 and showing an exploded view of the hinged connection between a vane portion and its associated hinge support flap;

FIG. 6 is a view of the X-shaped elongated insert for insertion inside the divider insert of the present invention;

DESCRIPTION OF THE PREFERRED EMBODIMENT

Figure 1:
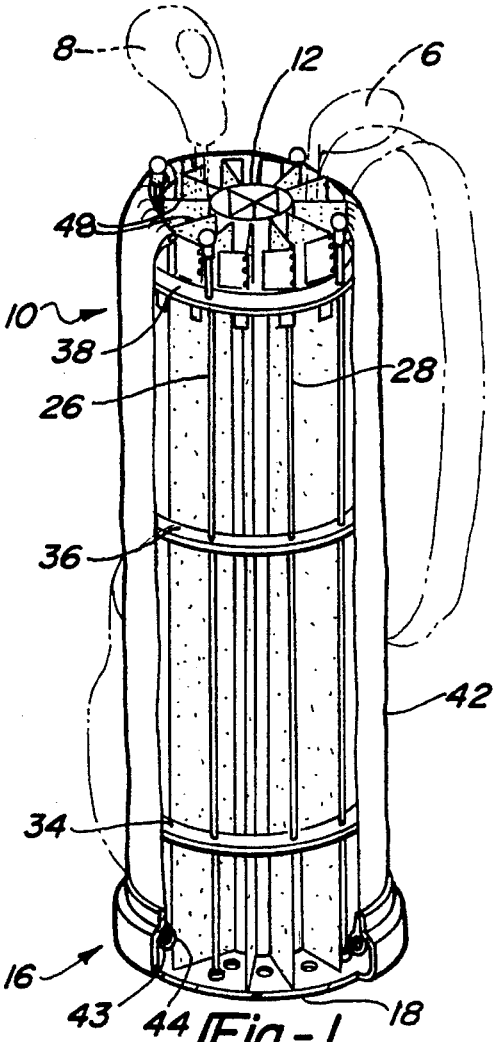
FIG. 1 is a perspective view, in cutaway, of the golf club divider insert and golf bag of the present invention.

Referring to FIG. 1, a golf club divider insert and golf bag enclosure assembly 10 according to the present invention is shown. The assembly 10 is primarily made up of a divider insert 12 and a golf bag support structure 14.

Figure 2:
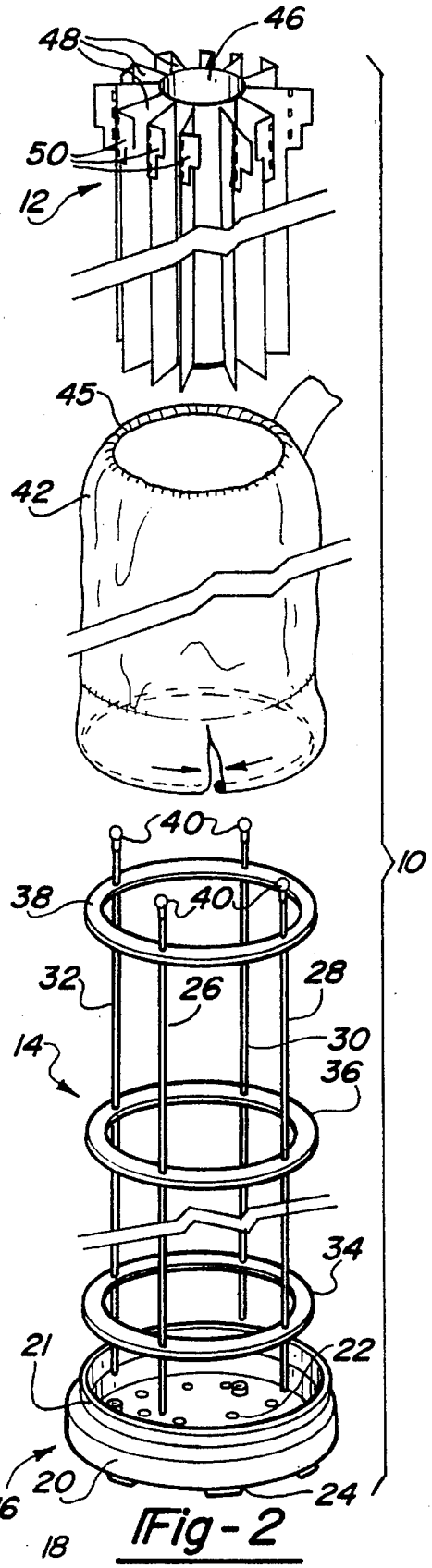
FIG. 2 is an exploded view of the divider insert and golf bag support structure.

Referring again to FIG. 1, and also to FIG. 2, the bag support structure 14 includes a durable base 16 having a flat bottom 18, a first circular side wall portion 20 and a second inwardly recessed side wall portion 21. A plurality of apertures 22 are formed into the flat bottom 18 and permit the draining of water which may collect within the bag during use. A series of stand-offs 24 extend from a bottom of the base to space the bag enclosure a desired distance from the ground surface.

A series of support rods 26, 28, 30 and 32 are affixed in an upright manner at different locations around the flat bottom 18 of the base by conventional fasteners and/or welding and extend upwardly from the base 16 in a generally parallel fashion. A series of three hollowed circular support disks 34, 36 and 38 are positioned at varying heights with respect to the base and are fixedly secured to the support rods 26, 28, 30 and 32 by fastening means which are known in the art. Preferably, the support rods are shaped with ledge support portions to support the disks at the spaced distances. Fastening means can be provided to fix the disks in place.

The lowermost support disk 34 is positioned in proximity to the base 16 and the uppermost disk 38 is positioned slightly below and in proximity to an open top of the bag structure. The intermediate support disk 36 is positioned in closer proximity to the uppermost disk 38 and is ideally spaced approximately 10" to 15" below the disk 38.

The support disks and support rods are all constructed of a durable plastic, aluminum, or other material which exhibits like characteristics. Each of the support rods 26, 28, 30 and 32 extends a predetermined distance above the uppermost support disk 38, preferably 4–6 inches and terminates in a cap portion 40.

An outer bag layer or skin 42 is made up of any type of conventional golf bag material and includes straps and pouches and is readily removable. Preferably, the skin of the golf bag is separately manufactured in such a way that it mounts or dismounts to or from the frame of the bag with relative ease by means of fastening straps. A shoulder strap or hand strap may also be manufactured separately so as to be mounted to the bag frame. Appendant structure may be connected to the disks and rods of the frame to facilitate and secure the assembly.

The bag 42 is secured at its lower end against an inner surface of the circular side wall 20 and around the four support rods (see FIG. 1). A ring-shaped spring portion 43 may be slidably inserted within an associated hem 44 around a bottom edge of the bag. The spring biases the bottom edge of the bag outwardly against the inside surface of the base 16 between the first and second inwardly recessed portions 20 and 21.

The cover terminates at its upper end in a heavy-duty elastic band 45 which is drawn against the support rods at a point just below the tops of the rods and is protected from damage by snagging against the support rods by the cap portions 40. The bag covering may be removed from the skeletal structure by disengaging the spring portion from within the inside of the base and lifting the bag upwardly and over the structure. In this way, replacement bags may be easily installed as desired. The bag may also have a zipper, not shown, to facilitate removal. Alternatively, a wrap around material may be applied around the bag covering to fasten the cloth bag to the frame.

Referring again to FIG. 1, and also to FIG. 2, the golf club divider insert 12 is constructed of a durable and resilient plastic, aluminum or like material and includes a hollow and elongated sleeve shaped member 46. As seen in FIG. 1, the sleeve member 46 extends in a preferred embodiment substantially above the height of the golf bag. The sleeve shaped member is also preferably of a cylindrical shape having a hollow and open interior but can also have an oval or other shaped cross section as desired.

A plurality of vanes 48 extend from the sleeve shaped member 46 at predetermined locations around a circumference of the sleeve member 46. The vanes 48 in a preferred embodiment extend the entire height of the sleeve shaped member, however they can also terminate collectively or individually short of the lower end or upper end of the sleeve member while still providing their necessary function. Additionally, the top plane of the divider does not have to be a plane in only one level. It is also possible that the plane can be stepped in 2–3 different levels so that the higher plane accommodates the longer irons, and the lower one the shorter irons. The number of vanes 48 can vary however there are usually enough of them to provide for twelve spaced apart and substantially trapezoidal shaped enclosures around the periphery of the golf bag for receiving the user's golf clubs.

As can be seen in FIG. 1, the divider insert 12 is slidably engaged within the enclosure defined by the bag interior so that the edges of the vanes 48 contact the inner edges of the hollowed circular support disks 34, 36 and 38. A shaft of a golf club, say an iron 6 or a driver 8, is shown in phantom in FIG. 1 within enclosures formed by succeeding vanes 48.

Referring again to FIG. 2, and further to FIG. 5, a plurality of hinge support flaps 50 are shown extending from each of the plurality of vanes 48. The hinge support flaps 50 are each connected to their associated vanes 48 by a first plurality of hollowed and spaced apart sleeve portions 52 which extend from the flaps 50. A second plurality of hollowed and spaced apart sleeve portions 54 extend from the edges of the vanes 48 and inter-engage with the first plurality of portions 52 to form a continuous and hollow sleeve 56 (see FIG. 3). A pin 58 is inserting through the engaging portions to hingedly secure the support flap 50 to the associated vane 48.

The hinge support flaps extend downwardly a predetermined distance from a top of the vanes, preferably 4" to 8", but normally do not extend the entire height of the associated vanes. The support flaps are each formed with a relatively larger upper body portion 60 and a smaller downwardly extending ledge support portion 62. The hinge support flaps and sleeve portions are constructed of a durable plastic or like material with resilient characteristics and allow the hinge support flaps to rotate relative to the vanes without weakening or breaking off the connection established therebetween.

Figure 7:
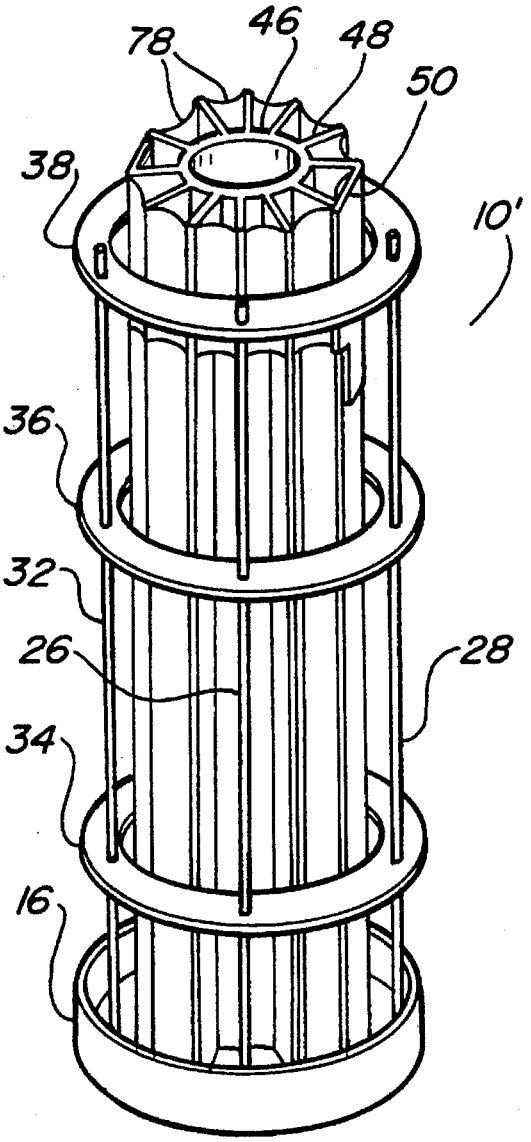
FIG. 7 is a view of a divider insert and bag assembly according to a further preferred embodiment and in a first folded position.

Referring to FIG. 4 and to FIG. 7, the hinge support flaps 50 are shown in a first rotated and flush position when the divider insert 12 is free-standing within the golf bag enclosure. In the first position, the flaps 50 are folded inwardly and in proximity to succeeding vanes and are prevented from pivoting axially outwardly by the inner surface of the upper most circular support disk 38.

It is however desirable in some instances to reposition the top surface of the divider insert 12 at an elevated location projecting further above the top of the golf bag. The primary reason for doing this is to engage the hinge support flaps at a sufficiently elevated position to reach the height of the head of the club and protect the projecting portions of the golf club shafts and heads from damage due to impact with external objects or other damage resulting from them knocking into one another.

Figure 3:
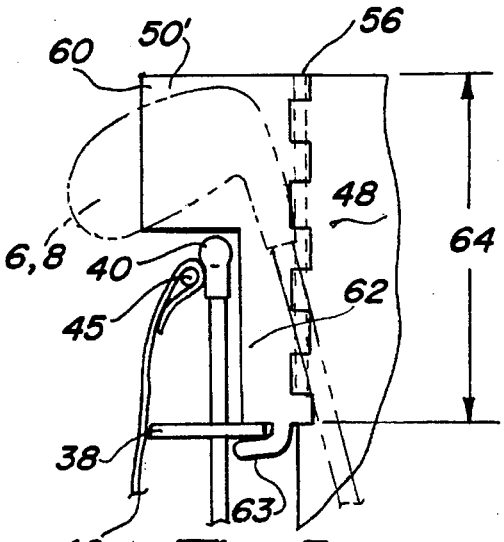
FIG. 3 is a sectional view of an upper portion of the divider insert which shows an unfolded hinge support flap in relation to an upper edge of the bag structure.
Figure 8:
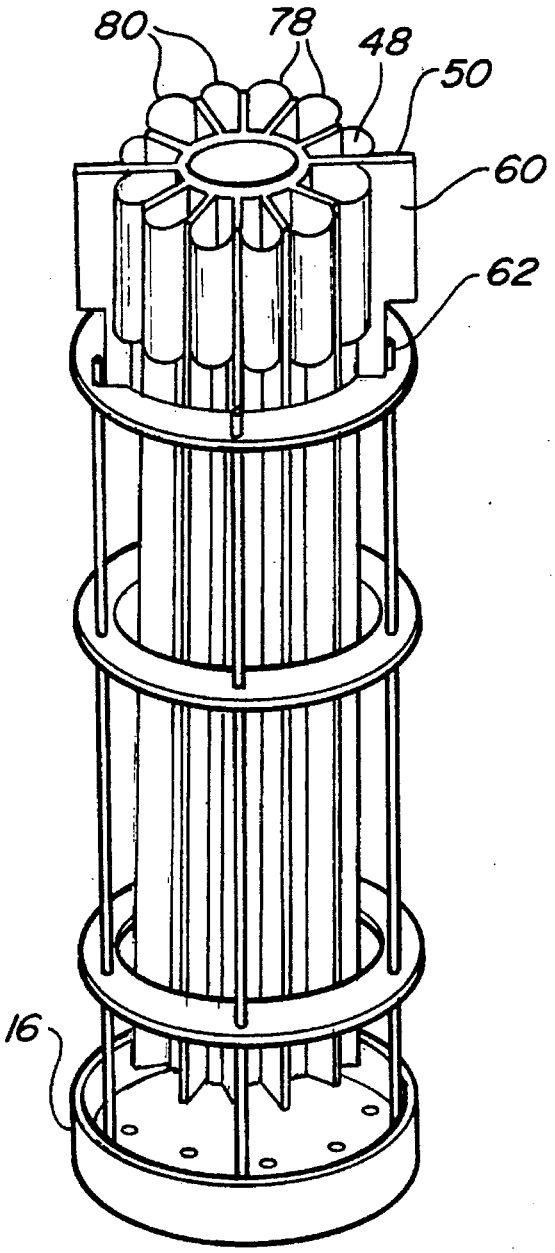
FIG. 8 is a view of a divider insert and bag assembly similar to FIG. 7 and in a second unfolded position.

Accordingly, referring again to FIG. 2 and to FIG. 8, and also to FIG. 3, the divider insert 12 may be lifted upwardly with respect to the golf club bag a predetermined distance from its first position to a second position in which the support flaps 50 clear the uppermost hollow disk 38 and are pivoted axially outwardly as shown in phantom at 63 (see FIG. 4), so that the ledge support portion 62 engages the upper surface of the disk 38 to support the insert in a raised position and the body portions 60 of the flaps protect the golf clubs. Referring to FIG. 3, flap 50' is shown in an axially extended position and, in combination with the remaining hinge support flaps, provides adequate support to elevate the divider insert a sufficient height 64 to shield the heads of the golf clubs with the top portion of the divider insert.

The second position of the divider insert is primarily used during the game of golf. The golfer draws up desired clubs out of the bag again and again during the game. While drawing the club, it is necessary to protect the insert from separating completely due to the upward motion of drawing. To restrain the insert from this undesirable effect, another foldable flap or restraining portion 63 (FIG. 3 and FIG. 5) is built to each of the plurality of vanes a fraction of an inch below the lower edge of the "ledge portion" of said hinge support flap, thus sharing the common hinge axis. Unfolded, the second flap is positioned just below the upper most disk 38 of the bag frame and restrains the insert from sliding out. The primary function of the broad part 60 of the foldable flaps are to shield the heads of iron clubs and partially the shafts also.

Figure 9:
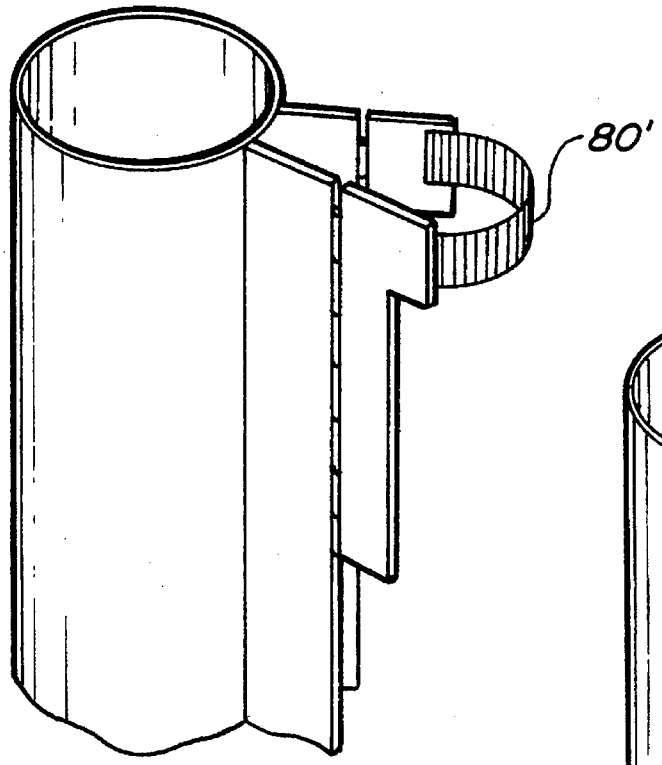
FIG. 9 is a view of a further preferred embodiment showing the protective fabric sheet attached to the hinge support flaps in an unfolded and outwardly axially extending position.
Figure 10:
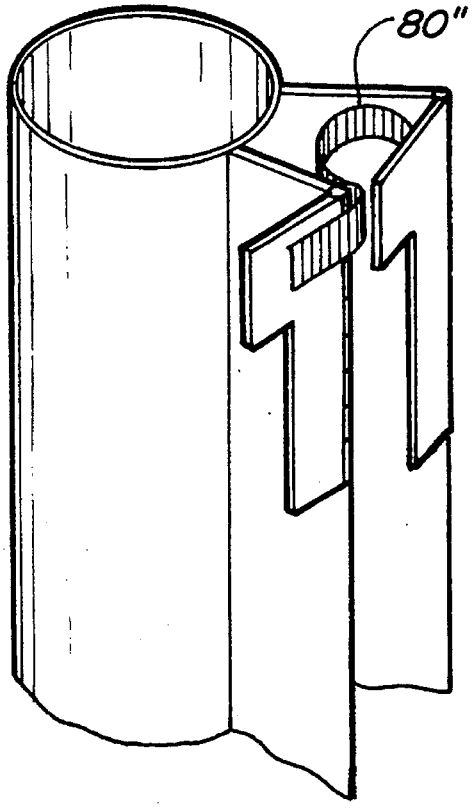
FIG. 10 is a view similar to that shown in FIG. 9 and showing the hinge support flaps with the protective sheet in an inwardly folded position.

FIGS. 7 and 8 show a further preferred embodiment 10' of the invention. Referring again to FIG. 8, a soft plastic material such as polyethylene or nylon sheet 78 is utilized for providing additional shielding capability. The sheet is cut in appropriate size and preferably rectangular in shape. A free edge of the sheet is affixed to a vane and the free edge of the opposing side of the sheet is affixed to the next adjacent vane along the vertical free edge in the upper portion of the vanes. The affixed plastic sheet is sufficiently large in size to make it a part of a pouch billowing outwardly from the vanes large enough to contain the head of an iron club. The pliable nature of the sheet permits it to be folded inwardly against the inside of the bag when the insert is not in use. According to the present invention, said protective fabric sheets are not limited to the vanes as a way of affixing. Protective sheets 80 may also extend between succeeding hinge support flaps. They also can be affixed to the hinge support flaps 80' and 80" as shown in FIGS. 9 and 10 respectively. Further, the present invention discloses that the three methods namely, the hinge support flaps without the protective fabric enclosure, the fabric sheet affixed to the vanes and the fabric sheet affixed to the hinge support flaps, are utilized in combination or singly for one said divider. Elastic properties can be incorporated in the fabric sheet to give resiliency. FIG. 9 is in the elevated view and FIG. 10 is a free standing closed position.

Referring again to FIG. 5, and also to FIG. 6, a substantially elongated and cross-shaped insert 66 is provided for insertion within a cavity 68 formed by the hollow sleeve member 46. The cross-shaped insert 66 is substantially X-shaped in cross section and extends substantially the same height as the divider insert 12 and the golf bag apparatus and provides additional enclosures for housing additional clubs, such as drivers. Pairs of overlapping and interengaging straps 74 and 76 (see FIG. 4) each preferably having engaging Velcro portions may also be provided along a base surface of each of the vanes for quickly and conveniently securing a golf club at a top portion of its shaft and within its associated enclosure.

The divider insert of the present invention may also be used with golf bags other than that which is disclosed. Specifically, the insert may also be utilized with any other golf bag which provides the necessary interior dimensions for receiving the insert and creating the circumferential compartmented enclosures.

Having described my invention, additional embodiments will become apparent to those skilled in the art to which it pertains without deviating from the scope of the appended claims.

I claim:

1. A golf club divider insert and golf bag, comprising:

said golf bag having a base, a frame secured to and extending upwardly from said base, a body covering material surrounding said frame, and an open top;

said divider insert having a hollow elongated and sleeve shaped member which has a longitudinal axis and extends substantially a height of said golf bag;

a plurality of elongated vanes extending outwardly at spaced intervals about a circumference of said hollow and sleeve shaped member so that said divider insert is slidably inserted in said golf bag and said vanes contact an inside of said frame, a plurality of golf clubs being placed successively into a plurality of elongated enclosures established between succeeding vanes; and at least a first axially hinged support flap pivotally mounted along an edge of a first one of said plurality of vanes and at least a second axially hinged support flap pivotally mounted along an edge of a second one of said plurality of vanes, said first and second flaps each further comprising at least one substantially horizontal ledge support surface, said first flap and said second flap unfolding outwardly in an axial direction relative to said first vane and said second vane and said horizontal ledge support surface engaging a top surface of said bag frame for supporting said divider insert at an elevated position relative to said golf bag so that a top of said insert projects a predetermined distance above said open top of said golf bag.

2. The golf club divider insert and golf bag as described in claim 1, further comprising a plurality of hinged support flaps equal in number to said plurality of elongated vanes, one of said hinged support flaps extending from an upper portion of each of said plurality of vanes respectively.

3. The golf club divider insert and golf bag according to claim 2 further comprising at least one foldable flap constructed of a fabric material extending in a curved pouch-like manner between successive hinged support flaps, said flaps shielding the heads of the golf clubs.

4. The golf club divider insert and golf bag according to claim 2 further comprising at least one foldable flap constructed of a fabric material extending in a curved pouch-like manner between successive vanes, said vanes shielding the heads of the golf clubs.

5. The golf club divider insert and golf bag as described in claim 2, each of said hinged support flaps further comprising:

an upper body portion and a downwardly extending ledge support portion including said horizontal ledge support surface;

a first plurality of hollow and axially spaced apart sleeve portions extending from a surface of said support flap;

a second plurality of hollow and axially spaced apart sleeve portions extending from a connecting surface of said associated vane and inter-engaging with said first plurality of sleeve portions to form a continuous hollow sleeve; and a pin being insertable through a continuous aperture formed by said continuous hollow sleeve to hingedly connect said support flap to said vane;

said support flaps being folded inwardly with respect to said vanes in a first position so that said insert is contained free-standing in said golf bag, said insert is withdrawn from said bag said predetermined distance in a second position so that said flaps can be rotated to a second position in which they are unfolded in said axial direction and said horizontal ledge support surface of said ledge support portion engages said top surface of said golf bag frame.

6. The golf club divider insert and golf bag as described in claim 5, further comprising a restraining portion extending from a bottom of of said ledge support portion, said restraining portion engaging an underside of said top surface of said golf bag frame to prevent accidental sliding of said insert out of said, bag when in said second unfolded position.

7. The golf club divider insert and golf bag as described in claim 1, further comprising an elongated cross shaped member insertable within a cavity formed by said sleeve shaped member, said cross shaped member extending substantially the height of said sleeve shaped member and defining a plurality of additional elongated compartment enclosures within said golf bag.

8. The golf club divider insert and golf bag as described in claim 1, further comprising fastening means including overlapping and inter-engaging straps attached to inside surfaces of said vanes in proximity to said elongated and sleeve shaped member for surrounding a shaft of the golf club and for drawing the golf club against a surface of said sleeve shaped member proximate to a surface of said projecting vanes.

9. The golf club divider insert and golf bag as described in claim 1, said bag frame further comprising:

a lower circular support disk, an intermediate circular support disk and an upper circular support disk positioned at varying heights above said base, said upper support disk forming said top surface of said frame; and a first support rod, a second support rod, a third support rod and a fourth support rod secured to and extending upwardly and in a substantially parallel manner from said base and engaging said support disks to maintain said disks in a spaced apart manner.

10. The golf club divider insert and golf bag as described in claim 9, said covering material comprising a removable and interchangeable cloth body which is secured at a lower end to said base and at an upper end around said support rods.

11. A golf club divider insert for use with a golf bag for containing a plurality of golf clubs, the golf bag having a base, a body having a given height and a supporting surface which defines an open top, said divider insert comprising:

an elongated sleeve shaped member having a longitudinal axis and extending substantially the height of said bag;

a plurality of vanes projecting from a surface of said sleeve shaped member in a spaced apart manner and around a circumference of said sleeve shaped member, said sleeve shaped member is inserted within the bag so that said vanes contact an inside of the bag and create a plurality of elongated enclosures between succeeding vanes, said enclosures each being capable of receiving one of the plurality of golf clubs; and a plurality of axially hinged support flaps pivotally mounted along the edges of each of said plurality of vanes, said support flaps each having at least one substantially horizontal ledge support surface, said flaps unfolding outwardly in an axial direction relative to said plurality of vanes so that said horizontal ledge support surfaces each engage the supporting surface of the bag for supporting a top of said insert at a point projecting above the open top of the golf bag.

12. The golf club divider insert as described in claim 11, each of said hinged support flaps further comprising:

an upper body portion and a downwardly extending ledge support portion including said horizontal ledge support surface;

a first plurality of hollow and axially spaced apart sleeve portions extending from a surface of said support flap;

a second plurality of hollow and axially spaced apart sleeve portions extending from a connecting surface of said associated vane and inter-engaging with said first plurality of receiving portions to form a continuous hollow sleeve; and a pin being insertable through a continuous aperture formed by said continuous hollow sleeve to hingedly connect said support flap to said vane;

said support flaps being folded inwardly with respect to said vanes in a first position so that said insert is contained free-standing within said golf bag, said insert is withdrawn from said bag a predetermined amount in a second position so that said flaps can be rotated to a second position in which they are unfolded outwardly in said axial direction and said horizontal ledge support surface of said ledge support portion engages said corresponding support surface of said golf bag.

* * * * *